US007759041B2

(12) United States Patent
Hong et al.

(10) Patent No.: US 7,759,041 B2
(45) Date of Patent: Jul. 20, 2010

(54) METHOD OF PREPARING TONER AND TONER PREPARED USING THE METHOD

(75) Inventors: Chang-kook Hong, Suwon-si (KR); Kyung-yol Yon, Seongnam-si (KR); Min-young Cheong, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 765 days.

(21) Appl. No.: 11/594,090

(22) Filed: Nov. 8, 2006

(65) Prior Publication Data

US 2007/0154832 A1 Jul. 5, 2007

(30) Foreign Application Priority Data

Jan. 5, 2006 (KR) ..... 10-2006-0001313

(51) Int. Cl.
*G03G 9/093* (2006.01)

(52) U.S. Cl. ..... 430/137.12

(58) Field of Classification Search ..... 430/137.12
See application file for complete search history.

(56) References Cited

U.S. PATENT DOCUMENTS 4,960,669 A * 10/1990 Mori et al. ..... 430/137.17
6,258,504 B1 * 7/2001 Bartus et al. ..... 430/137.17
6,342,328 B1 * 1/2002 Takasaki et al. ..... 430/108.22
6,544,706 B1 * 4/2003 Takasaki ..... 430/110.2
6,562,535 B1 * 5/2003 Masuo et al. ..... 430/108.22

FOREIGN PATENT DOCUMENTS

| | | |
|---|---|---|
| JP | 6-19182 | 1/1994 |
| JP | 10-177278 | 6/1998 |
| JP | 11-160909 | 6/1999 |
| KR | 2002-0012481 | 2/2002 |

* cited by examiner

*Primary Examiner*—Hoa V Le
(74) *Attorney, Agent, or Firm*—Roylance, Abrams, Berdo & Goodman, L.L.P.

(57) ABSTRACT

A method of preparing a toner, includes: preparing a high molecular weight latex particle by polymerizing a toner composition including a macromonomer having a hydrophilic group, a hydrophobic group and at least one reactive functional group, and at least one polymerizable monomer; forming a core particle by aggregating the high molecular weight latex particle; forming a shell layer by coating the core particle using a polymer having a higher glass transition temperature than a glass transition temperature of the core particle. Also, provided are a toner prepared using the method, an image forming method using the toner, and an image forming apparatus using the toner. Using the toner, an image can be fused at a low temperature. Also, durability of the toner is improved.

13 Claims, 1 Drawing Sheet

METHOD OF PREPARING TONER AND TONER PREPARED USING THE METHOD

CROSS-REFERENCE TO RELATED PATENT APPLICATION

This application claims the benefit under 35 U.S.C. §119 (a) of Korean Patent Application No. 10-2006-0001313, filed on Jan. 5, 2006, in the Korean Intellectual Property Office, the entire disclosure of which is hereby incorporated by reference.

BACKGROUND OF THE INVENTION

1. Field of the Invention

The present invention relates to a method of preparing a toner and a toner prepared using the method. More particularly, the present invention relates to a method of preparing a toner by forming a core using a latex particle and a shell layer by coating the core, a toner prepared using the method, an image forming method using the toner, and an image forming apparatus employing the toner.

2. Description of the Related Art

In an electrophotographic process or an electrostatic recording process, a developer used to form an electrostatic image or an electrostatic latent image may be a two-component developer formed of a toner and carrier particles, or a one-component developer formed of a toner only. The one-component developer may be a magnetic one-component developer having magnetic properties or a nonmagnetic one-component developer having no magnetic properties. Plasticizers such as colloidal silica are often added independently to the nonmagnetic one-component developer to increase the flowability of the toner. Generally, coloring particles obtained by dispersing a colorant, such as carbon black or other additives in a binding resin, are used in the toner.

Methods of preparing toners include pulverization or polymerization. In pulverization, the toner is obtained by melt mixing synthetic resins with colorants and, if needed, other additives. The mixture is then pulverized and particles are sorted until particles of a desired size are obtained. In polymerization, a polymerizable monomer composition is manufactured by uniformly dissolving or dispersing a polymerizable monomer, a colorant, a polymerization initiator and, if needed, various additives such as a cross-linking agent and an antistatic agent. Next, the polymerizable monomer composition is dispersed in an aqueous dispersive medium which includes a dispersion stabilizer using an agitator to form minute liquid droplet particles. Subsequently, the temperature is increased and suspension polymerization is performed to obtain a polymerized toner having color polymer particles of a desired size.

In an image forming apparatus such as an electrophotographic apparatus or an electrostatic recording apparatus, an electrostatic latent image is formed through light-exposing the surface of a photoreceptor that is uniformly charged. A toner is attached to the electrostatic latent image, and a resulting toner image is transferred to a transfer medium such as a paper through several processes such as heating, pressing, solvent steaming, or the like. In most fixing processes, the transfer medium with the toner image passes through fixing rollers and pressing rollers, and by heating and pressing, the toner image is fused to the transfer medium.

Images formed by an image forming apparatus such as an electrophotocopier should satisfy requirements of high precision and accuracy. Conventionally, a toner used in an image forming apparatus is usually obtained using pulverization.

When using pulverization, coloring particles having a wide range of sizes are likely formed. Hence, to obtain satisfactory developer properties, there is a need to sort the color particles obtained through pulverization according to size in order to reduce the particle size distribution. However, it is difficult to precisely control the particle size distribution using a conventional mixing/pulverizing process in the manufacture of toner particles suitable for an electrophotographic process or electrostatic recording process. Also, when preparing a minute particle toner, a toner preparation yield is low due to a sorting process. In addition, there is a limit to a change/adjustment of a toner design for obtaining desirable charging and fixing properties. Accordingly, polymerized toners, in which the size of particles is easy to control and which do not need to undergo a complex manufacturing process such as sorting, have come into spotlight recently.

When a toner is prepared using polymerization, a desired size distribution of particles is obtained without performing pulverization or sorting.

U.S. Pat. No. 6,033,822 to Hasegawa et al. discloses a polymerized toner including a core formed of colored polymer particles and a shell covering the core in molecules, wherein the polymerized toner is prepared by suspension polymerization, the entire disclosure of which is hereby incorporated by reference. However, it is still difficult to adjust the shape of the toner and the sizes of the particles. Also, the there is a wide distribution of particle sizes.

U.S. Pat. No. 6,258,911 to Michael et al. discloses a bifunctional polymer having a narrow polydispersity and an emulsion-condensation polymerization process for manufacturing a polymer having covalently bonded free radicals on each end, the entire disclosure of which is hereby incorporated by reference. However, even when this method is used, a surfactant can cause an adverse effect, and it is difficult to control the size of latex.

Accordingly, there is a need for an improved toner and method of preparing a toner having superior properties in particle size control, storability, durability, or the like.

SUMMARY OF THE INVENTION

Exemplary embodiments of the present invention address at least the above problems and/or disadvantages and provide at least the advantages described below. Accordingly, an aspect of the present invention is to provide a method of preparing a toner having superior properties in particle size control, storability, durability, or the like.

Exemplary embodiments of the present invention also provide a toner having superior properties in particle size control, storability, durability, or the like.

Exemplary embodiments of the present invention also provide an image forming method in which a high quality image can be fused at a low temperature by using a toner having superior properties in particle size control, storability, durability, or the like.

Exemplary embodiments of the present invention also provide an image forming apparatus in which a high quality image can be fused at a low temperature by using a toner having superior properties in particle size control, storability, durability, or the like.

According to an aspect of an exemplary embodiments of the present invention, a method of preparing a toner, includes: preparing a high molecular latex particle by polymerizing a toner composition where the toner compositions include a macromonomer having a hydrophilic group, a hydrophobic group and at least one reactive functional group and at least one polymerizable monomer. A core particle is formed by aggregating the high molecular latex particle. A shell layer is formed by coating the core particle using a polymer having higher glass transition temperature than the glass transition temperature of the core particle element.

According to another aspect of exemplary embodiments of the present invention, a toner includes: a core formed by aggregating a high molecular latex particle prepared by polymerizing a toner composition. The toner composition includes a macromonomer having a hydrophilic group, a hydrophobic group, and at least one reactive functional group, and at least one polymerizable monomer. A shell layer is formed on the surface of the core particle where the shell layer is a polymer having higher glass transition temperature than a glass transition temperature of the core element.

According to another aspect of exemplary embodiments of the present invention, an image forming method includes: forming a visible image by disposing a toner on a photoreceptor surface where an electrostatic latent image is formed, and transferring the visible image to a transfer medium. The toner includes a core formed by aggregating a high molecular latex particle prepared by polymerizing a toner composition. The toner composition includes a macromonomer containing a hydrophilic group, a hydrophobic group, and at least one reactive functional group, and at least one polymerizable monomer. A shell layer is formed on the surface of the core particle where the shell layer is a polymer having higher glass transition temperature than a glass transition temperature of the core element.

According to another aspect of exemplary embodiments of the present invention, an image forming apparatus includes: an organic photoreceptor; an image forming unit to form an electrostatic latent image on a surface of the organic photoreceptor; a toner cartridge to contain a toner; a toner supplying unit to supply the toner to the surface of the organic photoreceptor to develop the electrostatic latent image on the surface of the organic photoreceptor into a toner image; and a toner transferring unit to transfer the toner image from the surface of the organic photoreceptor to a transfer medium. The toner includes a core formed by aggregating a high molecular latex particle prepared by polymerizing a toner composition. The toner composition includes a macromonomer containing a hydrophilic group, a hydrophobic group, and at least one reactive functional group, and at least one polymerizable monomer. A shell layer is formed on the surface of the core particle where the shell layer is a polymer having higher glass transition temperature than a glass transition temperature of the core element.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWING

The above and other aspects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

Figure 1:
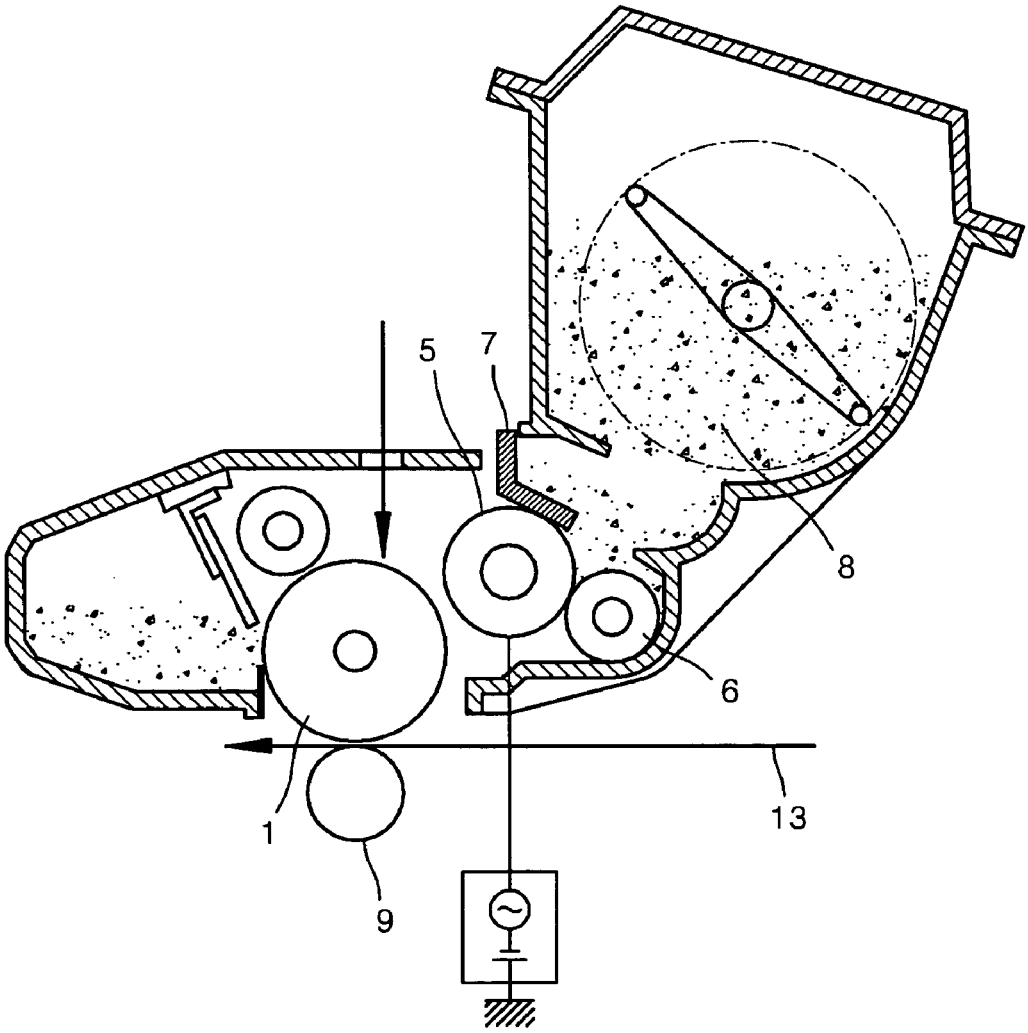
FIG. 1 is a schematic diagram of an image forming apparatus employing a toner prepared using a method according to an exemplary embodiment of the present invention.

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

An exemplary embodiment of the present invention provides a method of preparing a toner, including preparing a high molecular weight latex particle by polymerizing a toner composition including a macromonomer having a hydrophilic group, a hydrophobic group and at least one reactive functional group, and at least one polymerizable monomer. The method further includes forming a core particle by aggregating the high molecular weight latex particle. Still further, the method includes forming a shell layer by coating the core particle using a polymer having higher glass transition temperature than the glass transition temperature of the core particle.

In the method of the current exemplary embodiment, a polymerized toner having a core-shell structure is prepared. A toner particle which enables an image to be formed at a low temperature and has superior durability and storability is prepared by encapsulating a core particle having low molecular weight and Tg (glass transition temperature) with a crosslinked shell layer having relatively high Tg. After aggregating the high molecular weight latex particle, that is, after the forming of the core particle, an amount of a polymerizable monomer is added to increase Tg and the macromonomer is used as a comonomer for crosslinking to form the shell layer.

According to the method of the current exemplary embodiment, preparing the core includes the step of preparing the high molecular weight latex particle without using an emulsifier and aggregating the high molecular weight latex particle in order to obtain a toner particle having a desired size and configuration. Wax and a colorant may be added during the polymerization reaction or the aggregation process. The molecular weight and Tg of the obtained core particle are regulated for easy fusion of an image at a low temperature. Also, rheological properties of the core particle are regulated.

The rheological properties are regulated by a complex modulus of a dynamic test, that is, a storage modulus G' and a loss modulus G'. Also, the rheological properties are regulated by complex viscosity. In addition, a relaxation modulus of elasticity and a relaxation time can be measured. The stress-relaxation behavior is affected by the molecular weight and structure of a toner binder resin and the amount of wax in the toner. When the complex viscosity is too low ($1.0\times10^2$ Pas or less), offset or peeling failure occurs in a fusing device. When the complex viscosity is too high ($1.0\times10^4$ Pas or more), adhesion and glossiness deteriorate during fusion, and diffusion on a paper is bad.

On the other hand, for better fixation of an image at low temperatures, the molecular weight of the binder resin can be regulated to 30,000 or less, Tg can be regulated to about 50° C., and rheological properties can be lowered, but problems such as offset, or the like may occur. To solve such problems, the binder resin may be crosslinked by regulating the reactivity of the macromonomer, but problems such as durability, or the like, are not solved completely. Accordingly, the toner particle is encapsulated by forming the shell layer to increase the durability of the toner and solve problems that might occur during safekeeping when shipping or handling the toner.

At this time, a polymerization inhibitor may additionally be added to avoid the creation of new latex particles. Also, the reaction is performed using a starved-feeding condition for a monomer compound to be well coated on the toner particle. Tg of the shell layer is controlled using a well known Fox equation shown below.

$$1/Tg_{12}=w1/Tg_1+w2/Tg_2+\ldots.$$

wherein $Tg_{12}$ is Tg of a polymerized latex, $Tg_1$ and $Tg_2$ are Tg of monomers 1 and 2, respectively, and $w_1$ and $w_2$ are weight fraction of monomers 1 and 2, respectively.

The macromonomer is used as a comonomer when polymerizing the latex particle in the method of an exemplary embodiment of the present invention to maintain stability of the latex particle in an aqueous solution, so that an emulsifier is not used during the preparation and aggregation of the high molecular weight latex particle.

The macromonomer used in the method according to the current exemplary embodiment is an amphipathic material including both a hydrophilic group and a hydrophobic group, and a polymer or an oligomer including at least one terminal reactive functional group.

The hydrophilic group, chemically combined on the surface of the particle, increases a long term stability of the toner particles by providing steric stabilization, and can control the particle size of latex according to the amount or molecular weight of the injected macromonomer. The hydrophobic group promotes the emulsion polymerization by lying on the surface of toner particles. The macromonomer can form a copolymer by binding with a polymerizable monomer in the toner composition in various ways, such as grafting, branching, or cross-linking.

The weight average molecular weight of the macromonomer is in the range of about 100 to about 100,000, and preferably in the range of about 1,000 to about 10,000. When the weight average molecular weight of the macromonomer is less than 100, the properties of the toner may not improve or the macromonomer may not operate properly as a stabilizer. Also, when the weight average molecular weight of the macromonomer is greater than 100,000, a reaction conversion rate may be low.

The macromonomer may be, but is not limited to, a material selected from the group consisting of polyethylene glycol (PEG)-methacrylate, PEG-ethyl ether methacrylate, PEG-dimethacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate and polyester methacrylate.

The amount of the macromonomer may be in the range of about 1 to about 50 parts by weight based on 100 parts by weight of the toner composition. When the amount of the macromonomer is less than 1 part by weight based on 100 parts by weight of the toner composition, the stability of the particle distribution is low, and when the amount of the macromonomer exceeds 50 parts by weight based on 100 parts by weight of the toner composition, the property of the toner deteriorates.

An amphipathic macromonomer can act not only as a comonomer but also as a stabilizer. The reaction between initial radicals and monomers forms oligomer radicals, and provides an in situ stabilizing effect. The initiator decomposed by heat forms a radical, reacts with a monomer unit in an aqueous solution to form an oligomer radical, and increases hydrophobicity. The hydrophobicity of the oligomer radical accelerates the diffusion inside the micelle, accelerates the reaction with polymerizable monomers and facilitates a copolymerization reaction with a macromonomer.

Owing to the hydrophilicity of an amphipathic macromonomer, a copolymerization reaction can more easily occur in the vicinity of the surface of toner particles. The hydrophilic portion of the macromonomer located on the surface of the particle increases the stability of the toner particle by providing steric stability, and can control the particle size according to the amount or molecular weight of the injected macromonomer. Also, the functional group which reacts on the surface of the particle can improve the electric frictional properties of the toner.

The polymerizable monomer according to the method of the current exemplary embodiment may be a monomer selected from the group consisting of a vinyl monomer, a polar monomer having a carboxyl group, a monomer having an unsaturated polyester group and a monomer having a fatty acid group.

The polymerizable monomer may be formed of, but is not limited to, at least one material selected from the group consisting of styrene-based monomer such as styrene, vinyltoluene, and α-methylstyrene; acrylic acid and methacrylic acid; (meth)acrylic acid derivative such as methylacrylate, ethylacrylate, propylacrylate, butylacrylate, 2-ethylhexylacrylate, dimethylaminoethylacrylate, methylmethacrylate, ethylmethacrylate, propylmethacrylate, butylmethacrylate, 2-ethylhexylmethacrylate, dimethylaminoethylmethacrylate; (meth)acrylic acid derivative of amide selected from the group consisting of acrylonitrile, methacrylonitrile, acrylamide and methacrylamide; ethylenically unsaturated monoolefin such as ethylene, propylene and butylene; halogenated vinyl such as vinyl chloride, vinylidene chloride and vinyl fluoride; vinyl ester such as vinyl acetate and vinyl propionate; vinyl ether such as vinyl methyl ether and vinyl ethyl ether; vinyl ketone such as vinyl methyl ketone and methyl isopropenyl ketone; and a vinyl compound having nitrogen such as 2-vinyl pyridine, 4-vinyl pyridine and N-vinyl pyrrolidone.

The amount of the polymerizable monomer used in the method of the current exemplary embodiment is in the range of 3 to 50 parts by weight based on 100 parts by weight of the toner composition. When the amount of the polymerizable monomer is less than 3 parts by weight based on 100 parts by weight of the toner composition, the yield is low. When the amount of the polymerizable monomer exceeds 50 parts by weight based on 100 parts by weight of the toner composition, the stability of the toner composition is low.

The medium used in the method of the current exemplary embodiment may be an aqueous solution or a mixture of water and an organic solvent.

A detailed process of preparing a core and a shell coating the core of the polymerized toner according to the current exemplary embodiment is as follows.

A toner composition including a macromonomer and a polymerizable monomer is polymerized to prepare a high molecular weight latex particle. While purging a reactor with nitrogen gas, or the like, a medium, such as diluted deionized water (or a mixture of water and an organic solvent), and a compound of macromonomers are injected in the reactor, and the resultant is stirred and heated. At this time, an electrolyte such as NaCl or an ion salt can be added to control the ionic strength of a reaction medium. When the temperature inside the reactor reaches an appropriate value, an initiator, such as a water soluble free radical initiator, is injected in the reactor. Subsequently, at least one polymerizable monomer, preferably together with a chain transfer agent, is injected semicontinuously into the reactor. To control the reaction rate and the degree of dispersion, the injection of the polymerizable monomer may be performed using a starved condition process.

The toner composition may include a colorant and wax. The colorant in a mixture of the macromonomer and deionized water is dispersed using a disperser. Not to effect the reaction, the dispersed colorant solution is injected in the reactor during a polymerization reaction and the polymerization reaction is allowed to continue. When the injection of the dispersed colorant solution is too fast, the conversion rate of the reaction may be effected. When the injection of the dispersed colorant solution is too late, a rate of the amount of the colorant in the toner composition or dispersibility of the colorant may not be good. When the reaction is performed to some extent, a dispersion of wax dispersed in a monomer mixture is injected in the reactor, and an initiator is further injected to continue the reaction. The polymerization reaction time is determined based on the temperature and experimental conditions, between the range of 6 hours to 12 hours, by measuring the reaction speed and the conversion rate. After the reaction, a high molecular weight latex particle can be prepared by further injecting a monomer to regulate the durability and other properties of the toner particle. Accordingly, a core is formed by aggregating the high molecular weight latex particles to form toner particles.

The method of the current exemplary embodiment includes the forming of a shell layer on the aggregated core. After the aggregation, Tg of the shell layer is increased relative to the Tg of the latex particles by regulating the rate of the addition of the poylmerizable monomer, and the crosslinked shell layer is formed using the macromonomer as a comonomer. The toner particles can be encapsulated by dropwise adding the initiator and a monomer component containing the macromonomer to the reactor. At this time, a polymerization inhibitor may additionally be added to avoid the creation of new latex particles. Also, a reaction is performed using a starved-feeding condition for a monomer compound to be well coated on the toner particles.

The preparation and aggregation processes of the high molecular weight latex particles do not involve the use of an emulsifier, so that a cleaning process during separation and filtration processes of the prepared toner particles is minimized. By minimizing the cleaning process, the preparation process is simplified and the production costs can be reduced. Also, by reducing the amounts of polluted water and waste water, the method is very advantageous environmentally. In addition, by not using the emulsifier, problems such as sensitivity at high density, low triboelectric charge, low dielectricity, and weak toner flow can be prevented, and the storage stability of the toner can be improved remarkably.

The toner composition according to the current exemplary embodiment may include a colorant and wax. The colorant may be carbon black or aniline black in the case of a black toner. Also, it is easy to produce a color nonmagnetic toner according to an exemplary embodiment of the present invention. In the case of a color toner, carbon black is used as a colorant for black, and a yellow colorant, a magenta colorant, and a cyan colorant are further included as colorants for the respective colors.

The yellow colorant may be a condensed nitrogen compound, an isoindolinone compound, an anthraquinone compound, an azo metal complex, or an aryl imide compound. By way of example, C.I. pigment yellow 12, 13, 14, 17, 62, 74, 83, 93, 94, 95, 109, 110, 111, 128, 129, 147, 168, 180, or the like, may be used.

The magenta colorant may be a condensed nitrogen compound, anthraquinone, a quinacridone compound, a lake pigment of basic dye, a naphthol compound, a benzoimidazole compound, a thioindigo compound, or a perylene compound. By way of example, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like, may be used.

The cyan colorant may be a copper phthalocyanine compound or a derivative thereof, an anthraquinone compound, or a lake pigment of basic dye. By way of example, C.I. pigment blue 1, 7, 15, 15:1, 15:2, 15:3, 15:4, 60, 62, 66, or the like, may be used.

These colorants may be used alone or in combinations of two or more types. A desired colorant is selected considering color, saturation, brightness, weatherability, and dispersibility in a toner.

The amount of the colorant may be in the range of about 0.1 to about 20 parts by weight based on the 100 parts by weight of a polymerizable monomer. The amount of the colorant is not particularly limited as long as it is sufficient to color the toner. When the amount of the colorant is less than 0.1 parts by weight, the coloring is insufficient. When the amount of the colorant exceeds 20 parts by weight, the production costs of the toner increases and the toner is unable to obtain enough triboelectric charge.

A suitable wax which provides a desired characteristic of the final toner compound may be used. The wax may be, but is not limited thereto, polyethylene wax, polypropylene wax, silicon wax, paraffin wax, ester wax, carnauba wax or metallocene wax. The melting point of the wax may be in the range of about 50 to about 150° C. Wax components physically adhere to the toner particles, but do not covalently bond with the toner particles. The toner is fixed to a final image receptor at a low fixation temperature and has superior final image durability and an antiabrasion property.

The toner composition according to the current exemplary embodiment may include at least one material selected from the group consisting of an initiator, a chain transfer agent, a charge control agent and a release agent.

Radicals in the toner composition are formed by the initiator, and the radical may react with the polymerizable monomer. The radical reacts with the polymerizable monomer and the reactive functional group of the macromonomer to form a copolymer.

Examples of the radical polymerized initiator include persulfates, such as potassium persulfate, ammonium persulfate, and the like; azo compounds, such as 4,4-azobis(4-cyanovaleric acid), dimethyl-2,2'-azobis(2-methylpropionate), 2,2-azobis(2-amidinopropane)dihydrochloride, 2,2-azobis-2-methyl-N-1,1-bis(hydroxymethyl)-2-hydroxyethylpropionamide, 2,2'-azobis(2,4-dimethylvaleronitrile), 2,2'-azobisisobutyronitrile, 1,1'-azobis(1-cyclohexanecarbonitrile), etc.; peroxides, such as methylethylperoxide, di-t-butylperoxide, acetylperoxide, dicumylperoxide, lauroylperoxide, benzoylperoxide, t-butylperoxide-2-ethylhexanoate, di-isopropylperoxydicarbonate, di-t-butylperoxyisophthalate, or the like. Also, an oxidation-reduction initiator, which is a combination of a polymerized initiator and a reducing agent, may be used.

The chain transfer agent is a material which converts the type of a chain carrier during a chain reaction. The conversion of the new chain carrier includes considerably reduced activity compared to the previous chain carrier. Using the chain transfer agent, the degree of polymerization of the monomer may be reduced, or the new chain reaction may be initiated. Also, the range of the molecular weight may be regulated using the chain transfer agent.

The chain transfer agent may include, but is not limited to, a compound containing sulfur, such as dodecanethiol, thioglycolic acid, thioacetic acid or mercaptoethanol; a phosphorous acid compound, such as phosphorous acid or sodium phosphorous acid; a hypophosphorous acid compound, such as hypophosphorous acid or sodium hypophosphorous acid; and alcohol, such as methylalcohol, ethylalcohol, isopropylalcohol or n-butyl alcohol.

The release agent protects a photoreceptor and prevents deterioration of developing properties, and thus may be used for obtaining a high quality image. A release agent according to an exemplary embodiment of the present invention may use a solid fatty acid ester material with high purity. For example, a low molecular weight polyolefin, such as low molecular weight polyethylene, low molecular weight polypropylene, low molecular weight polybutylene, or the like; paraffin wax; or a multifunctional ester compound, or the like, may be used. The release agent used in an exemplary embodiment of the present invention may be a multifunctional ester compound formed from a polyhydric alcohol having at least three functional groups and carboxylic acid.

The polyhydric alcohol with at least three functional groups may be an aliphatic alcohol, such as glycerin, pentaerythritol, pentaglycerol, or the like; an alicyclic alcohol, such as chloroglycitol, quersitol, inositol, or the like; an aromatic alcohol, such as tris (hydroxymethyl)benzene, or the like; a sugar, such as D-erythrose, L-arabinose, D-mannose, D-galactose, D-fructose, sucrose, maltose, lactose, or the like; or a sugar-alcohol, such as erythrite, or the like.

The carboxylic acid may be an aliphatic carboxylic acid, such as acetic acid, butyric acid, caproic acid, enantate, caprylic acid, pelargonic acid, capric acid, undecanoic acid, lauric acid, myristic acid, stearic acid, magaric acid, arachidic acid, cerotic acid, sorbic acid, linoleic acid, linolenic acid, behenic acid, tetrolic acid, or the like; an alicyclic carboxylic acid, such as cyclohexanecarboxylic acid, hexahydroisophthalic acid, hexahydroterephthalic acid, 3,4,5,6-tetrahydrophthalic acid, or the like; or an aromatic carboxylic acid, such as benzoic acid, cumic acid, phthalic acid, isophthalic acid, terephthalic acid, trimeth acid, trimellitic acid, hemimellitic acid, or the like.

The charge control agent may be formed of a material selected from the group consisting of a salicylic acid compound containing a metal, such as zinc or aluminum, a boron complex of bisdiphenylglycolic acid, and silicate. More particularly, dialkyl salicylic acid zinc or boro bis(1,1-diphenyl-1-oxo-acetyl potassium salt) may be used.

According to another exemplary embodiment of the present invention, there is provided a toner including: a core formed by aggregating a high molecular weight latex particle prepared by polymerizing a toner composition comprising a macromonomer having a hydrophilic group, a hydrophobic group, and at least one reactive functional group, and at least one polymerizable monomer; and a shell layer formed on the surface of the core particle prepared using a polymer having higher glass transition temperature than the core element.

The preparing of the high molecular weight latex particle and the aggregating of the high molecular latex particle may be performed without an emulsifier. The details thereof are as described above. The average volumetric particle size of the toner particle may be in the range of about 0.5 to about 20 μm, preferably in the range of about 5 to about 10 μm.

A radical formed by an initiator reacts with the polymerizable monomer, and the reactive functional group of the macromonomer to form a copolymer. The copolymer may be formed by copolymerizing at least one monomer selected from the group consisting of a vinyl monomer, a polar monomer having a carboxyl group, a monomer having an unsaturated polyester group and a monomer having a fatty acid group. The weight average molecular weight of the copolymer may be in the range of about 2,000 to about 200,000.

The weight average molecular weight of the macromonomer may be in the range of about 100 to about 100,000, and is preferably in the range of about 1,000 to about 10,000. The macromonomer may be, but is not limited to, a material selected from the group consisting of polyethylene glycol (PEG)-methacrylate, PEG-ethyl ether methacrylate, PEG-dimethacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate and polyester methacrylate.

According to another exemplary embodiment of the present invention, there is provided an image forming method including: forming a visible image by disposing a toner on a photoreceptor surface where an electrostatic latent image is formed; and transferring the visible image to a transfer medium, wherein the toner includes: a core formed by aggregating a high molecular weight latex particle prepared by polymerizing a toner composition including a macromonomer containing a hydrophilic group, a hydrophobic group, and at least one reactive functional group, and at least one polymerizable monomer; and a shell layer formed on the surface of the core particle prepared using a polymer having higher glass transition temperature than the core element.

An electrophotographic image forming process includes a charging process, a light-exposing process, a developing process, a transferring process, a fusing process, a cleaning process and an antistatic process, which are series of processes to form an image on an image receptor.

In the charging process, the photoreceptor is charged with electric charges of desired polarity, either negative or positive, by a corona or a charging roller. In the light-exposing process, an optical system, generally a laser scanner or an array of diodes, forms a latent image corresponding to a final visual image to be formed on an image receptor by selectively discharging the charging surface of the photoreceptor in an imagewise manner. Electromagnetic radiation (hereinafter, "light") may be infrared radiation, a visible ray, or ultraviolet radiation.

In the developing process, in general, the toner particles with suitable polarity contact the latent image on the photoreceptor, and typically, an electrically biased developer which has a potential with the same polarity as the toner is used. The toner particles move to the photoreceptor, selectively adhere to the latent image through static electricity, and form a toner image on the photoreceptor.

In the transferring process, the toner image is transferred from the photoreceptor to a desired final image receptor. Sometimes, an intermediate transferring element is used to effect the transfer of the toner image from the photoreceptor to the final image receptor.

In the fixing process, the toner image is fixed to the final image receptor by melting or softening the toner particles by heating the toner image on the final image receptor. Alternatively, the toner can be fixed to the final image receptor under high pressure while being heated or unheated.

In the cleaning process, the toner particles remaining on the photoreceptor are removed.

In the antistatic process, an electric charge on the photoreceptor is exposed to light of a certain wavelength, and the electric charge is substantially decreased to a uniform low value. Consequentially, a residue of the latent image is removed and the photoreceptor is prepared for the image forming cycle.

According to an exemplary embodiment of the present invention, there is provided an image forming apparatus including: an organic photoreceptor; a unit charging a surface of the organic photoreceptor; a unit containing a toner; a unit supplying the toner to the surface of the organic photoreceptor to develop an electrostatic latent image on the surface of the organic photoreceptor into a toner image; and a unit transferring the toner image on the surface of the organic photoreceptor to a transfer medium, wherein the toner includes: a core formed by aggregating a high molecular weight latex particle prepared by polymerizing a toner composition including a macromonomer containing a hydrophilic group, a hydrophobic group, and at least one reactive functional group, and at least one polymerizable monomer; and a shell layer formed on the surface of the core particle prepared using a polymer having higher glass transition temperature than the core element.

FIG. 1 is a schematic diagram of a non-contact developing type image forming apparatus using a toner prepared using the method according to an exemplary embodiment of the present invention. The operating principles of the image forming apparatus are explained below.

A developer 8, which is a nonmagnetic one-component developer, is supplied to a developing roller 5 through a feeding roller 6 formed of an elastic material such as a polyurethane foam or sponge. The developer 8 supplied to the developing roller 5 reaches a contact point between the developing roller 5 and a developer regulation blade 7 as the developing roller 5 rotates. The developer regulation blade 7 is formed of an elastic material such as metal, rubber, or the like. When the developer 8 passes the contact point between the developing roller 5 and the developer regulation blade 7, the developer 8 is smoothed to form a thin layer that is sufficiently charged. The developing roller 5 transfers the thin layer of the developer 8 to a developing domain where the thin layer of the developer 8 is developed on the electrostatic latent image of a photoreceptor 1, which is a latent image carrier.

The developing roller 5 and the photoreceptor 1 face each other with a constant distance therebetween. The developing roller 5 rotates counterclockwise and the photoreceptor 1 rotates clockwise. The developer 8 transferred to the developing domain forms an electrostatic latent image on the photoreceptor 1 according to the intensity of an electric charge generated due to a difference between a voltage applied to the developing roller 5 and a latent image potential of the photoreceptor 1.

The developer 8 developed on the photoreceptor 1 reaches a transferring device 9 as the photoreceptor 1 rotates. The developer 8 developed on the photoreceptor 1 is transferred through corona discharging or by a roller to a printing paper 13 as the printing paper 13 passes between the photoreceptor 1 and the transferring device 9. The transferring device 9 receives a high voltage with an opposite polarity to the developer 8, and thus forms an image.

The image transferred to the printing paper 13 passes through a fusing device (not shown) that provides high temperature and high pressure, and the image is fused to the printing paper 13 as the developer 8 is fused to the printing paper 13. Meanwhile, the developer 8 remaining on the developing roller 5 and which is not developed is transferred back to the feeding roller 6 contacting the developing roller 5. The above processes are repeated.

Exemplary embodiments of the present invention will now be described in greater detail with reference to the following examples. The following examples are for illustrative purposes only and are not intended to limit the scope of the exemplary embodiments of the present invention.

EXAMPLES

Example 1

While purging the inside of a reactor with nitrogen gas, 800 g of toner composition which completed aggregation was injected into the reactor and heated while stirring at 250 RPM. When the internal temperature of the reactor reached 82° C., 1.6 g of potassium persulfate (available from KPS), as a water soluble free radical initiator, and 8 g of polyethylene glycol methacrylate (available from Aldrich) in 60 g of deionized water were injected to the reactor. Also, 81 g of monomer compound including styrene, n-butyl acrylate and methacrylate in a ratio of 8:1:1 and 1.5 g of 1-dodecanthiol as a chain transfer agent were added to the reactor using a starved feeding process. During this time, a reaction time and capsulization were confirmed by measuring the toner particle size and a reaction conversion rate. After the reaction, latex particle size slightly increased and the conversion rate was almost 100%. The thickness of the shell layers obtained was 0.3 μm and the average volumetric particle size of the particles prepared was 7 μm. When the reaction was completed, the product was cooled and filtrated to obtain toner particles.

Example 2

A toner composition was prepared in the same manner as in Example 1, except that 8 g of polyethylene glycol ethylether methacrylate (available from Aldrich) was added with deionized water during the initial stage of the reaction instead of polyethylene glycol methacrylate. After the reaction, latex particle size slightly increased and the conversion rate was almost 100%. The thickness of the shell layers obtained was 0.3 μm and the average volumetric particle size of the particles prepared was 7 μm. When the reaction was completed, the product was cooled and filtrated to obtain toner particles.

Example 3

A toner composition was prepared in the same manner as in Example 1, except that 8 g of hexafunctional polyester acrylate was added with deionized water during the initial stage of the reaction instead of polyethylene glycol methacrylate. After the reaction, the latex particle size slightly increased and the conversion rate was almost 100%. The thickness of the shell layers obtained was 0.3 μm and the average volumetric particle size of the particles prepared was 7 μm. When the reaction was completed, the product was cooled and filtrated to obtain toner particles.

Example 4

A toner composition was prepared in the same manner as in Example 1, except that 8 g of dendritic polyester acrylate was added with deionized water during the initial stage of the reaction instead of polyethylene glycol methacrylate. After the reaction, latex particle size slightly increased and the conversion rate was almost 100%. The thickness of the shell layers obtained was 0.3 μm and the average volumetric particle size of the particles prepared was 7 μm. When the reaction was completed, the product was cooled and filtrated to obtain toner particles.

Example 5

A toner composition was prepared in the same manner as in Example 1, except that 8 g of urethane acrylate was added with deionized water during the initial stage of the reaction instead of polyethylene glycol methacrylate. After the reaction, latex particle size slightly increased and the conversion rate was almost 100%. The thickness of the shell layers obtained was 0.3 μm and the average volumetric particle size of the particles prepared was 7 μm. When the reaction was completed, the product was cooled and filtrated to obtain toner particles.

Example 6

A toner composition was prepared in the same manner as in Example 1, except that 8 g of urethane methacrylate was added with deionized water during the initial stage of the reaction instead of polyethylene glycol methacrylate. After the reaction, latex particle size slightly increased and the conversion rate was almost 100%. The thickness of the shell layers obtained was 0.3 μm and the average volumetric particle size of the particles prepared was 7 μm. When the reaction was completed, the product was cooled and filtrated to obtain toner particles.

Comparative Example 1

346 g of styrene-(n-butyl acrylate) copolymer latex particles, polymerized using an emulsifier, was injected to 307 g of ultra-high pure water in which 0.5 g of an SDS emulsifier was dissolved, and the resultant was stirred. 18.2 g of pigment particles (cyan 15:3, 40 solidity %) dispersed by the SDS emulsifier were added to obtain a latex pigment dispersed aqueous solution. While stirring at 350 RPM, the pH of the latex pigment dispersed aqueous solution was titrated to pH 10 using a 10% NaOH buffer solution. 30 g of ultra-high pure water was dissolved in 10 g of $MgCl_2$ as an aggregating agent, and the result was dropwise added to the latex pigment aqueous solution for about 10 minutes. The temperature of the result was increased to 95° C. After about 7 hours of heating to obtain desired particle size, the reaction was stopped and the product was allowed to cool naturally. The average volumetric particle size was about 10.5 μm.

According to exemplary embodiments of the present invention, dispersibility of wax is improved by preparing a core particle by aggregating a high molecular weight latex particle and by forming a shell layer by coating the core particle with a polymer. Accordingly, fixability, anti-offset properties, triboelectric charge properties and storage stability of a toner are improved and high quality images are able to be produced. Also, a cleaning process can be simplified and the generation of polluted water and waste water can be decreased, which is very advantageous environmentally.

While certain exemplary embodiments of the invention has have been shown and described herein with reference to a certain preferred embodiments thereof, it will be understood by those skilled in the art that various changes in form and details may be made therein without departing from the spirit and scope of the invention as defined by the appended claims and their equivalents.

What is claimed is:

1. A method of preparing a toner, comprising:

preparing a high molecular weight latex particle by polymerizing a toner composition, the toner composition including a macromonomer having a hydrophilic group, a hydrophobic group and at least one reactive functional group, and at least one polymerizable monomer;

forming a core particle by aggregating the high molecular weight latex particle, wherein the forming of the high molecular weight latex particle and the aggregating the high molecular latex weight particle are performed without an emulsifier; and forming a shell layer by coating the core particle with a polymer having a higher glass transition temperature than a glass transition temperature of the core particle, wherein the macromonomer is formed of a material selected from the group consisting of polyethylene glycol (PEG)-methacrylate, PEG-ethyl ether methacrylate, PEG-modified urethane, PEG-modified polyester, polyacrylamide (PAM), PEG-hydroxyethyl methacrylate, dendritic polyester acrylate, carboxy polyester acrylate, fatty acid modified epoxy acrylate, and polyester methacrylate.

2. The method of claim 1, wherein the shell layer is formed by copolymerizing a polymerizable monomer and a macromonomer having a hydrophilic group, a hydrophobic group and at least one reactive functional group.

3. The method of claim 1, wherein the preparing of the high molecular weight latex particle comprises using at least one material selected from the group consisting of a colorant and a wax.

4. The method of claim 1, wherein the forming of the core particle comprises using at least one material selected from the group consisting of a colorant and a wax.

5. The method of claim 1, wherein the weight average molecular weight of the macromonomer is in the range of about 100 to about 100,000.

6. The method of claim 1, wherein the amount of the macromonomer is in the range of about 1 to about 50 parts by weight based on 100 parts by weight of the toner composition.

7. The method of claim 1, wherein the polymerizable monomer comprises at least one monomer selected from the group consisting of a vinyl monomer, a polar monomer having a carboxyl group, a monomer having unsaturated polyester, and a monomer having a fatty acid group.

8. The method of claim 7, wherein the polymerizable monomer comprises at least one material selected from the group consisting of a styrene-based monomer selected from the group consisting of styrene, vinyltoluene, and α-methylstyrene; acrylic acid; methacrylic acid; a (meth)acrylic acid derivative selected from the group consisting of methylacrylate, ethylacrylate, propylacrylate, butylacrylate, 2-ethylhexylacrylate, dimethylaminoethylacrylate, methylmethacrylate, ethylmethacrylate, propylmethacrylate, butylmethacrylate, 2-ethylhexylmethacrylate, and dimethylaminoethylmethacrylate; a (meth)acrylic acid derivative of amide selected from the group consisting of acrylonitrile, methacrylonitrile, acrylamide and methacrylamide; an ethylenically unsaturated monoolefin selected from the group consisting of ethylene, propylene and butylene; a halogenated vinyl selected from the group consisting of vinyl chloride, vinylidene chloride and vinyl fluoride; a vinyl ester selected from the group consisting of vinyl acetate and vinyl propionate; a vinyl ether selected from the group consisting of vinyl methyl ether and vinyl ethyl ether; a vinyl ketone selected from the group consisting of vinyl methyl ketone and methyl isopropenyl ketone; and a vinyl compound having nitrogen selected from the group consisting of 2-vinyl pyridine, 4-vinyl pyridine and N-vinyl pyrrolidone.

9. The method of claim 1, wherein the amount of the polymerizable monomer is in the range of about 3 to about 50 parts by weight based on 100 parts by weight of the toner composition.

10. The method of claim 1, wherein the preparing of the high molecular weight latex particle further comprises using at least one material selected from the group consisting of an initiator, a chain transfer agent, a charge control agent, and a release agent.

11. The method of claim 1, wherein the colorant comprises one material selected from the group consisting of yellow, magenta, cyan, black pigments and mixtures thereof.

12. The method of claim 2, wherein the macromonomer of the toner composition for forming the core is the same as the macromonomer for forming the shell.

13. The method of claim 2, wherein the macromonomer of the toner composition for forming the core is different from the macromonomer for forming the shell.

* * * * *